US006790122B2

(12) United States Patent
Mitchell et al.

(10) Patent No.: US 6,790,122 B2
(45) Date of Patent: Sep. 14, 2004

(54) CIRCULAR KNIT BRA HAVING DIFFERENT AREAS OF STRETCHABILITY AND METHOD OF MAKING THE SAME

(75) Inventors: John Mitchell, Asheboro, NC (US); Sandra Ann Waitz, Dingmans Ferry, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/093,076

(22) Filed: Mar. 7, 2002

(65) Prior Publication Data

US 2003/0171066 A1 Sep. 11, 2003

(51) Int. Cl.[7] ..... A41C 3/00
(52) U.S. Cl. ..... 450/66; 450/75
(58) Field of Search ..... 450/1, 20, 21, 450/34, 65–69, 70–73, 75, 76, 92; 2/67; 66/171, 176, 177, 153, 172 E, 170

(56) References Cited

U.S. PATENT DOCUMENTS 2,888,930 A * 6/1959 Coleman et al. ..... 450/76
2,971,513 A * 2/1961 Gingras ..... 450/76
3,056,411 A * 10/1962 Dugan ..... 450/74
3,093,137 A * 6/1963 Dugan ..... 450/74
3,173,421 A * 3/1965 Steiner ..... 450/75
3,353,540 A * 11/1967 Erteszek ..... 450/75
3,411,510 A * 11/1968 Child ..... 450/74
3,566,878 A * 3/1971 Radomski ..... 450/73
3,606,891 A * 9/1971 Marcario et al. ..... 450/74
3,699,971 A * 10/1972 Hittel et al. ..... 450/73
4,340,064 A * 7/1982 Vale ..... 450/73
5,167,566 A * 12/1992 Novitsky et al. ..... 450/74
5,171,182 A * 12/1992 Heinen ..... 450/74

* cited by examiner

*Primary Examiner*—Gloria M. Hale
(74) *Attorney, Agent, or Firm*—Ohlandt, Greeley, Ruggiero & Perle, L.L.P.

(57) ABSTRACT

There is provided a circular knit brassiere having a body portion with a pair of breast cups and a pair of side panels. Each side panel is connected to a different breast cup. The brassiere has different degrees of stretchability in each breast cup and side panel as compared to the center region of the brassiere. Tighter stitches with shorter stitch lengths than in the center region are used in the breast cups, thereby providing support for the breasts. Looser stitches, with longer stitch lengths than in the center region, are used in each side to provide improved flexibility and comfort to the wearer.

22 Claims, 4 Drawing Sheets

CIRCULAR KNIT BRA HAVING DIFFERENT AREAS OF STRETCHABILITY AND METHOD OF MAKING THE SAME

BACKGROUND OF THE INVENTION

1. Field of the Invention

The present invention relates to brassieres and methods of making same. More particularly, the present invention provides circular knit brassieres having varying degrees of stretchability in a body portion or half of a brassiere that includes a breast cup and its respective side panel. The present invention further provides that the body portion has different degrees of stitch tightness and density.

2. Description of the Prior Art

Modern brassieres are designed in an attempt to accommodate the needs for comfort during wear, as well as support. Thus, these brassieres attempt to provide flexibility, freedom of movement, and breast support.

Circular knit brassieres have become popular since they appear to maximize comfort and flexibility. Circular knit technology has been used to create brassieres that accommodate a need for maximum stretchability and freedom of movement.

While brassieres of circular knit construction have become popular, they may not have provided for the maximum comfort and flexibility that are desired in an undergarment, as well as breast cup support. Therefore, a need still exists for a circular knit brassiere having maximum support and comfort in the breast cups, yet increased flexibility, support and comfort, as well as stability, throughout the remainder of the brassiere.

SUMMARY OF THE INVENTION

It is an object of the present invention to provide a seamless circular knit brassiere having different or varying degrees of stretchability in the body portion or portions of the brassiere, that is differing in degrees of stretchability about the waistline direction of the brassiere.

It is another object of the present invention to provide such a seamless circular knit brassiere in which the different degrees of stretchability are three or more discrete areas in the brassiere along the body portion.

It is yet another object of the present invention to provide such a seamless circular knit brassiere in which the different degrees of stretchability is gradual throughout all or a substantially all of the body portion.

It is still another object of the present invention to provide such a seamless circular knit brassiere in which the different degrees of stretchability are achieved by differences in density and stitch construction.

It is still yet another object of the present invention to provide a seamless circular knit brassiere that has progressive areas of differential stretchability from the breast cup to the back along the body portion of the brassiere.

It is a further object of the present invention to provide a seamless circular knit brassiere that has a tighter stitch in the breast cup and a less tighter stitch in the side and/or rear panel of the body portion.

It is still a further object of the present invention to provide a method of making a seamless circular knit brassiere having integrally selected knitted areas with varying degrees of stretchability.

It is yet a further object of the present invention to provide a method of making such a seamless circular knit brassiere in which the different degrees of stretchability are achieved by different stitch tightness and density.

It is still yet a further object of the present invention to provide such a method of making a seamless circular knit brassiere in which select yarn feed-in tensioning is used while either changing or still maintaining the same basic stitch construction configuration.

These and other objects and advantages of the present invention are achieved by a brassiere formed from a circular knit bra blank. The brassiere has a body portion with a pair of breast cups and side panels with each side panel connected to a different one of the pair of breast cups. The brassiere has different degrees of stretchability in each breast cup and side panel, as compared to the center or center region of the brassiere. Tighter stitches than in the center region are used in the breast cups, thereby providing support for the breasts. Looser stitches than in the center region are used in the side panels of the brassiere to provide improved flexibility and comfort to the wearer.

In a preferred embodiment, each side panel has at least two discrete areas or regions of different stretchability. The region of the side panel nearest to the breast cup has a lesser degree of stretchability than the region of the side panel farthest from the breast cup. In still another preferred embodiment of the present invention, the different degrees of stretchability in the side panels are gradual throughout each side panel.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF THE INVENTION

Figure 1:
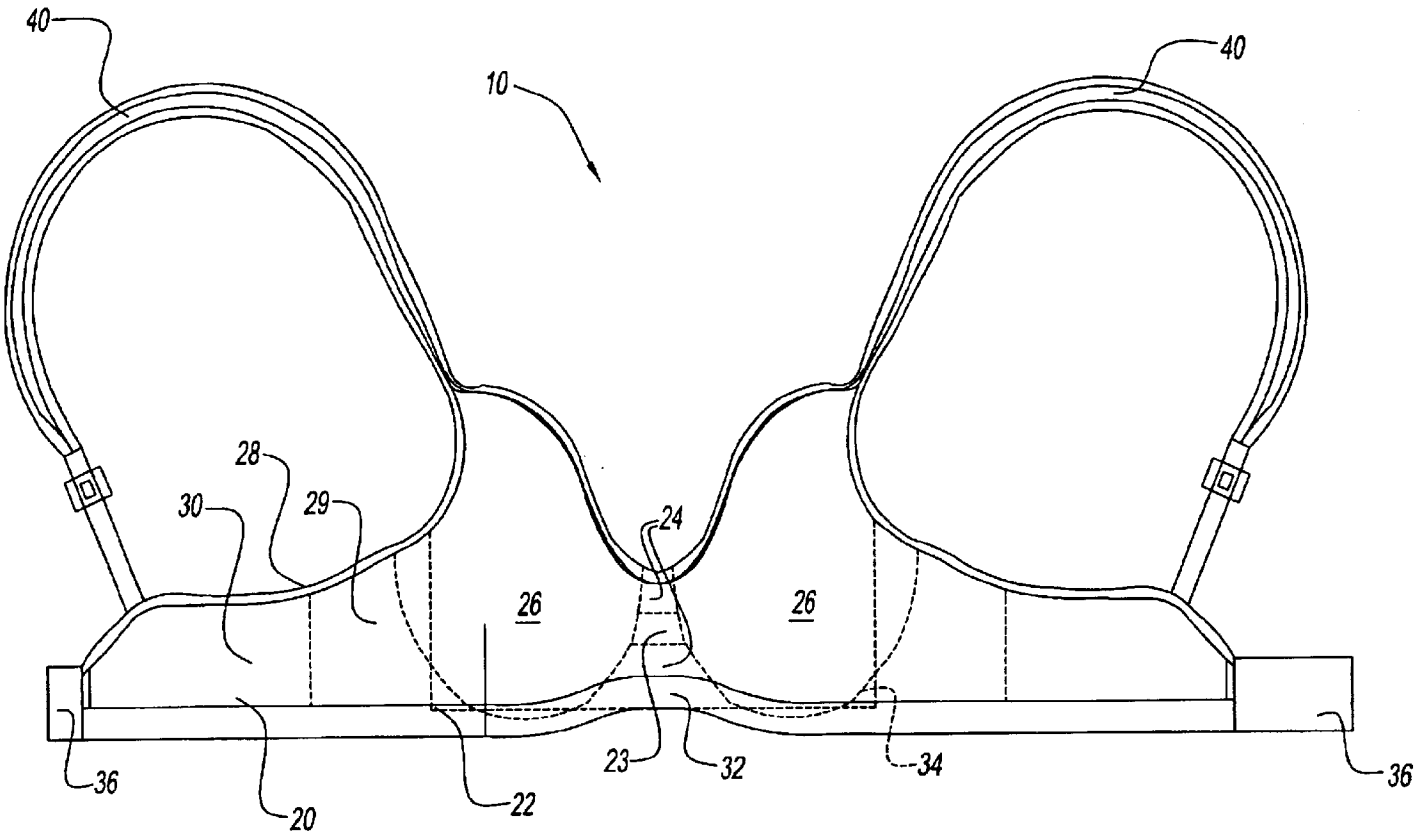
FIG. 1 is a front view of a brassiere according to a first embodiment of the present invention.

Referring to the drawings, and in particular FIG. 1, there is provided a bra or brassiere according to the present invention generally represented by reference numeral 10. Brassiere 10 is preferably formed from a unitary, circular knit bra blank so that there are no seams. Brassiere 10 can be a single layer or two or more layers of fabric. Preferably, brassiere 10 is formed of a single layer of fabric.

Referring to FIG. 1, brassiere 10 has a body portion 20. In a less preferred embodiment, brassiere 10 can be formed of two or more integrally connected body portions 20. Body portion 20 has a center region 22 with a pair of breast cups 26, and a pair of side panels 28 positioned adjacent to its respective breast cup. The portion of the center region 22 that does not include breast cups 26 is an area 24. Area 24 includes an anchor chest band 23. Brassiere 10 preferably has a pair of shoulder straps 40 with each shoulder strap connected to a different portion of body portion 20. The shoulder straps 40 are preferably adjustable.

Brassiere 10 may also have a pair of underwires 34 with each underwire disposed adjacent a lower margin edge of a different one of the pair of breast cups 26 to provide support. Brassiere 10, and in particular body portion 20, can terminate in a lower marginal edge 32.

Each side panel 28, and thus body portion 20, is removably joined to the other side panel at the back of the wearer by conventional fasteners 36, such as, a hook-and-eye, snap, or velcro closure, to form a back closure brassiere 10. However, such fasteners 36 can be in center region 22 so that brassiere 10 would be a front closure brassiere.

Figure 3:
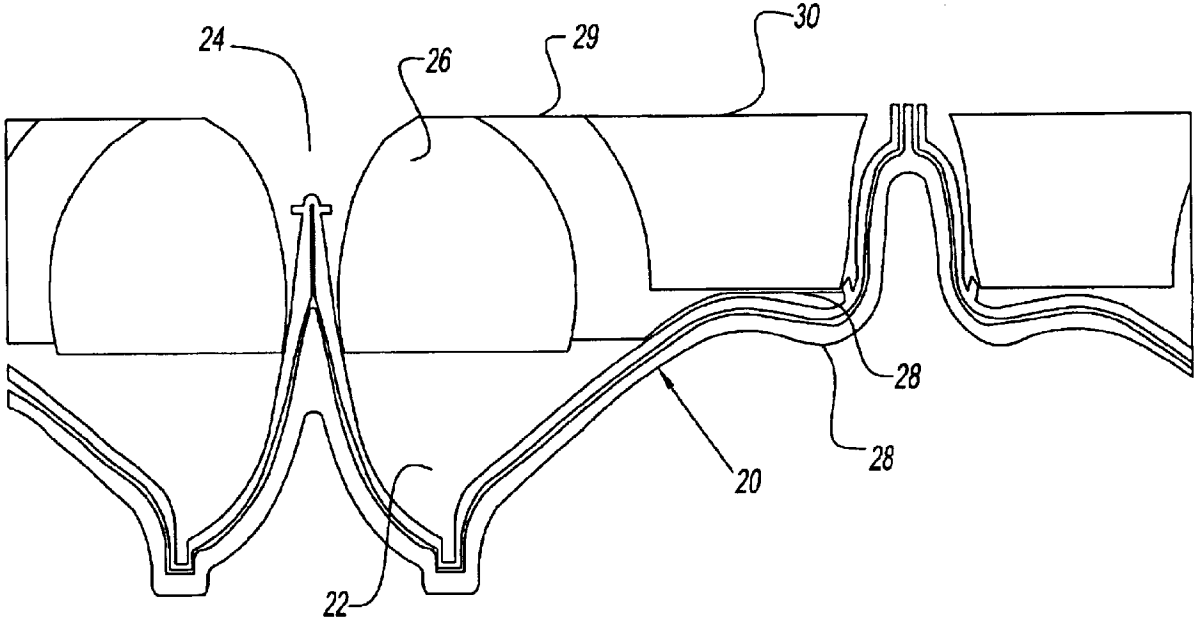
FIG. 3 is a schematic view of the differential tightness areas in the body portion of the brassiere of FIG. 1.

As shown in FIG. 3, center region 22 has area 24 that is the area of the center region except for breast cup 26. This area 24 has a baseline stretchability that is considered zero for the purposes of this application.

Breast cup 26 has a first degree of stretchability that is less than baseline or area 24. U.S. application Ser. No. 10/093,077, now U.S. Pat. No. 6,685,535 which is incorporated herein by reference, shows each breast cup 26 having discrete or different or varying areas of stretchability in the breast cup itself.

Side panel 28 of body portion 20 preferably has at least two discrete or somewhat discrete side panel areas or regions, namely first or inner side panel region 29 and second or outer side panel region 30. The first or inner side panel region 29 is positioned between breast cup 26 and second, or outer side panel region 30. Inner side panel region 29 has a second degree of stretchability, while outer side panel region 30 has a third degree of stretchability. Inner side panel region 29 and outer side panel region 30, respectively second and third regions of stretchability, have a greater stretchability than area 24. Also, outer side panel region 30 has a greater stretchability than inner side panel region 29.

Thus, body portion 20 has a baseline of zero stretchability in area 24. Each breast cup 26 has a lesser degree of stretchability than baseline or area 24. Inner side panel region 29 has a greater degree of stretchability than baseline in area 24 and each breast cup 26, while outer side panel region 30 has an even greater degree of stretchability than baseline (area 24), breast cups 26 and side panel 29. Accordingly, stretchability of body portion 20 increases from breast cups 26 to fasteners 36.

Figure 2:
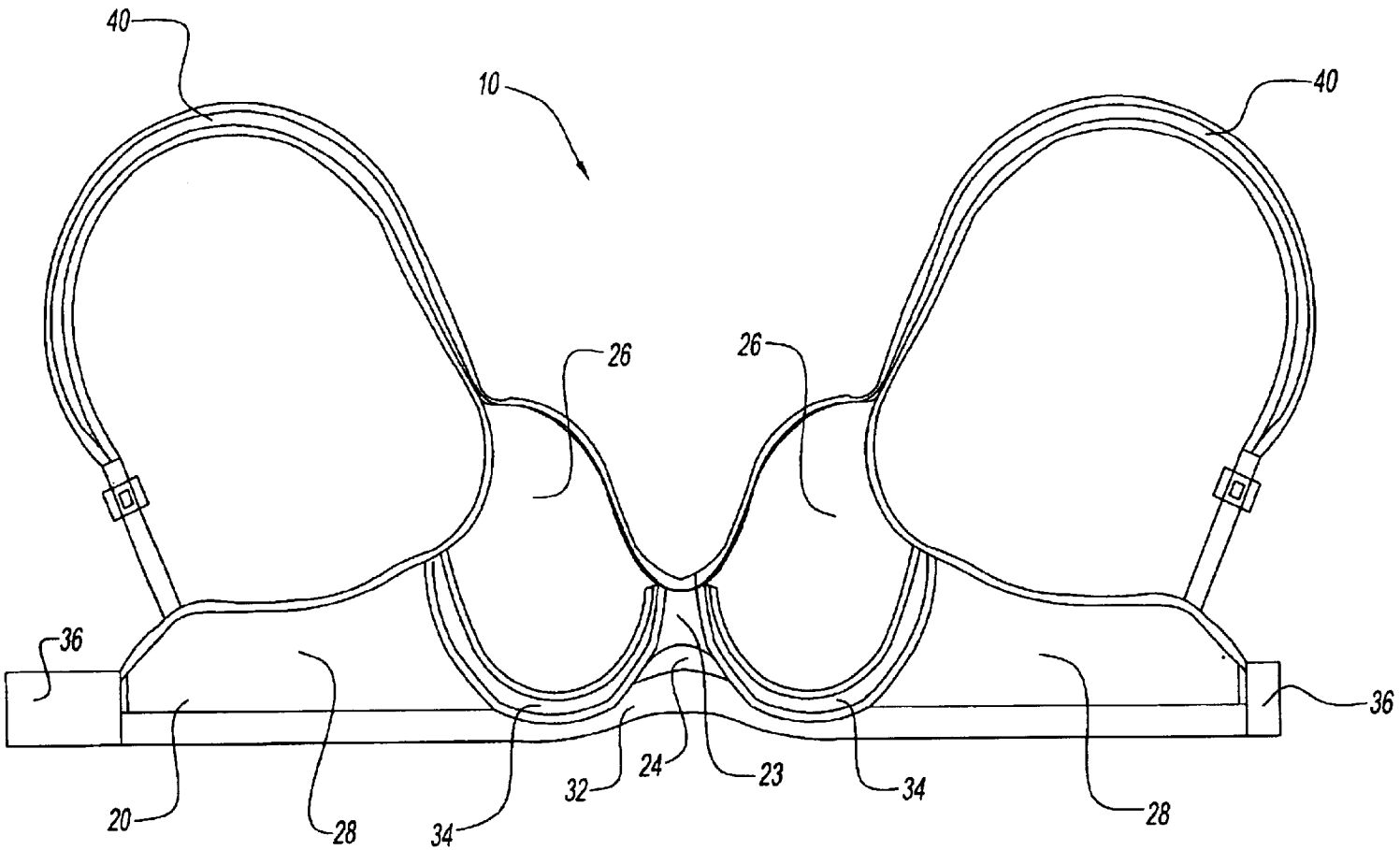
FIG. 2 is a rear view of a brassiere according to a second embodiment of the present invention.

FIG. 2 illustrates the rear portion of brassiere 10 having a second embodiment of the present invention. In this embodiment, breast cup 26 again has a lesser degree of stretchability than baseline or area 24, and side panel 28 has a greater degree of stretchability than baseline or area 24. However, side panel 28 does not have any discrete regions of stretchability, but instead has a gradual or progressive increase in stretchability starting adjacent breast cups 26 and moving away from area 24 toward fasteners 36. Thus, as in the first embodiment, stretchability of body portion 20 increases from breast cups 26 to fasteners 36.

While the knit construction or stitch pattern of brassiere 10 may be formed of one or more conventional knit stitches, the degrees of stretchability are achieved by differences in stitch tightness/length or stitch density.

Figure 4:
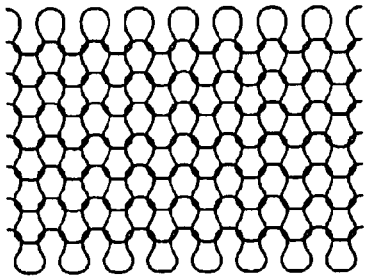
FIG. 4 is the stitch of highest density, having shorter stitch lengths, of a breast cup of the brassiere of the present invention.

FIG. 4 illustrates an example of the tightest stitch pattern. This stitch pattern has the shortest stitch length, and therefore the tightest stitch density. This stitch is used in breast cup 26. As discussed above, the copending application discusses the preferred embodiment in which breast cup 26 has areas or zones of varying tight stitch patterns, all of which are preferably tighter than stitches in area 24.

Figure 5:
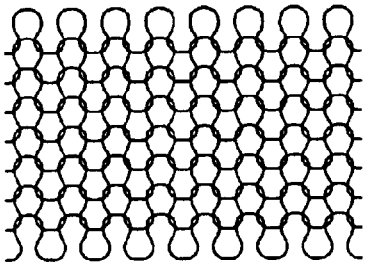
FIG. 5 is the stitch of intermediate density, having longer stitch lengths, of the breast cup of the brassiere of the present invention.
Figure 6:
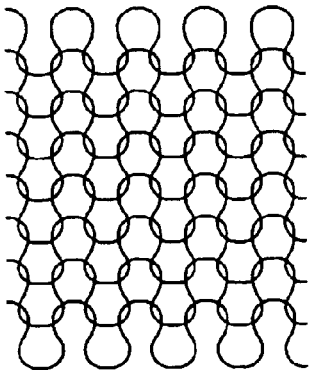
FIG. 6 is the stitch of least density, having the longest stitch lengths, of the breast cup of the brassiere of the present invention.

FIG. 5 illustrates an example of the intermediate stitch density pattern used in inner side panel region 29 of FIG. 3. This stitch pattern has a medium stitch length, and therefore a medium stitch density. FIG. 6 illustrates an example of the loosest stitch pattern having a longer stitch length, and therefore a lower stitch density. This stitch is used in outer side panel region 30, of the FIG. 1 embodiment of the present invention. In the FIG. 2 embodiment, side panel 28 would have progressive or gradual varying stitch patterns that would preferably range from the intermediate stitch pattern of FIG. 5 to the loose stitch pattern of FIG. 6.

In a stitch graduation test in which brassiere blanks were knitted using various stepping motor values, the cross stretch of the fabric used areas or regions of brassiere 10 was determined. The knitting machine most commonly used in circular knit technology is manufactured under the brand name Santoni®. The software used to run the Santoni® circular knit machine allows the user to assign a stepping motor value that determines the knit tension of the fabric. At the default, Santoni® stepping motor value of 60, which is considered the baseline zero point, the cross stretch of the fabric tubular blank was 32.3 inches. Thus, area 24, which is baseline zero point, has a cross stretch of 32.3 inches.

Breast cup 26 area is knitted at a Santoni stepping motor value of −30. Using this value, breast cup 26 area has been measured with a tubular blank cross stretch of 24 inches, which is a −26% difference from the baseline value of 32.3 inches. This means that breast cup 26 has 26% less stretch or is tighter than baseline or area 24. Preferably, the cross stretch of breast cup 26 ranges about −25% to about −30% of baseline. More preferably, the cross stretch of breast cup 26 is −26% of baseline. The tighter stitches in breast cup 26 result in a breast cup that retains significant opacity properties and does not become more sheer in coverage, particularly during molding of the cups than the remaining bra body fabric and side panel portions.

As shown in FIGS. 1 and 3, the first preferred embodiment of the present invention has discrete inner and outer side panel regions 29 and 30, respectively. As shown in FIGS. 5 and 6, the stitch length in each of these inner and outer side panel regions 29, 30 is different. Using looser stitches provides more flexible and normally greater comfort to the wearer, while decreasing the amount of support. Clearly, outer side panel region 30 has more flexibility and more comfort, yet less support, than inner side panel region 29. However, in a brassiere, less support and more flexibility and comfort is desired toward the back of the wearer where outer side panel region 30 is located.

Inner side panel region 29, which is located adjacent to breast cup 26, has the intermediate stitch pattern illustrated in FIG. 5. Inner side panel region 29 is knitted at a Santoni® stepping motor value of +6. Using this value, inner side panel region 29 has a cross stretch of 33.7 inches on the tubular blank, which is a 4% increase of the baseline or baseline value of 32.3 inches. Preferably, the cross stretch of inner side panel region 29 ranges about 2% to about 8% higher than the baseline. More preferably, the cross stretch of inner side panel region 29 is 4% greater than the baseline.

Outer side panel region 30, which in this embodiment is located immediately adjacent to inner side panel region 29, has the looser stitch pattern illustrated in FIG. 6. Outer side panel region 30 is knitted at a Santoni® stepping motor value of +14. Using this value, outer side panel region 30 in testing the tubular blank has a cross stretch of 35.8 inches, which is an 11% increase of the baseline value of 32.3 inches. Preferably, the cross stretch of outer side panel region 30 ranges about 8% to about 15% of baseline. More preferably, the cross stretch of outer side panel region 30 is 11%.

Brassiere 10 preferably is knit of an elastomeric or stretch knitted fabric. Such fabrics may be made by varying combinations of cotton or polyester or nylon and spandex yarns. Such yarns provide softness, comfort, and desired wicking properties.

While the two embodiments of the present invention discussed herein show each of breast cups 26 adjacent inner side panel region 29 or side panel 28, a panel may be inserted and either sewn, glued, or thermofused onto body portion 20 between the breast cup and the side panel region or side panel provided this panel does not effect the stretchability of inner side panel region 29 or side panel 28.

The present invention has been described with particular reference to the preferred embodiments. It should be understood that the foregoing descriptions and examples are only illustrative of the invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A circular knit brassiere comprising:

a body portion having a center region, said center region having a pair of breast cups, a pair of side panels, and an area between said pair of breast cups, wherein each of said pair of breast cups is positioned between the area and a different one of the pair of side panels, wherein said area has a baseline of stretchability, each of said breast cups has a first degree of stretchability, and each of said pair of side panels has a second degree of stretchability.

2. The brassiere of claim 1, wherein said first degree of stretchability has less stretch than the baseline.

3. The brassiere of claim 2, wherein said second degree of stretchability has greater stretch than the baseline.

4. The brassiere of claim 1, wherein said first degree of stretchability is derived from tighter stitch length and density than stitch length and density of the baseline.

5. The brassiere of claim 1, wherein said second degree of stretchability has greater stretch than the baseline.

6. The brassiere of claim 5, wherein said second degree of stretchability is derived from looser stitch length and density than the stitch length and density of the baseline.

7. The brassiere of claim 1, wherein each of said side panels has at least two regions of stretchability.

8. The brassiere of claim 1, wherein each of said pair of side panels has two regions of stretchability.

9. The brassiere of claim 8, wherein said two regions of stretchability include an inner side panel region adjacent a different one of said pair of breast cups, and an outer side panel region adjacent said inner side panel region, and wherein said outer side panel region has greater stretchability than said inner side panel region.

10. The brassiere of claim 9, wherein said inner side panel region has a cross stretch ranging about 2% to about 8% of the baseline.

11. The brassiere of claim 9, wherein said outer side panel region has a cross stretch ranging about 8% to about 15% of the baseline.

12. The brassiere of claim 1, wherein said breast cup has a cross stretch ranging about −25% to about −30% of the baseline.

13. The brassiere of claim 1, wherein each of said pair of side panels has progressive degrees of stretchability with less stretchability adjacent said area.

14. A circular knit brassiere comprising:

a body portion having a center region, said center region having a pair of breast cups, a pair of side panels and an area between said pair of breast cups, wherein said area has a baseline of stretchability, each of said pair of breast cups has a first degree of stretchability that is less than the baseline, and each of said side panels has a second degree of stretchability that is greater than the baseline.

15. The brassiere of claim 14, wherein said first degree of stetchability has a higher degree of stitch tightness and density with shorter stitch length than said second degree of stretchability.

16. The brassiere of claim 14, wherein each of said side panels has two regions of stretchability.

17. The brassiere of claim 16, wherein said two regions of stretchability include an inner side panel region adjacent a different one of said pair of breast cups, and an outer side panel region adjacent said inner side panel region.

18. The brassiere of claim 17, wherein said inner side panel region has said second degree of stretchability, and wherein said outer side panel region has a third degree of stretchability that is greater said second degree of stretchability of said inner side panel region.

19. The brassiere of claim 17, wherein said inner side panel region has a cross stretch ranging about 2% to about 8% of the baseline.

20. The brassiere of claim 17, wherein said outer side panel region has a cross stretch ranging about 8% to about 15% of the baseline.

21. The brassiere of claim 14, wherein each of said breast cups has a cross stretch ranging about −25% to about −30% of the baseline.

22. The brassiere of claim 14, wherein each of said side panels has progressive degrees of stretchability with less stretchability adjacent a different one of said pair of breast cups.

* * * * *